US006553742B2

(12) United States Patent
Spatafora

(10) Patent No.: US 6,553,742 B2
(45) Date of Patent: Apr. 29, 2003

(54) METHOD AND MACHINE FOR WRAPPING CIGARS

(75) Inventor: Mario Spatafora, Bologna (IT)

(73) Assignee: G.D Societa' Per Azioni, Via Pomponia (IT)

( * ) Notice: Subject to any disclaimer, the term of this patent is extended or adjusted under 35 U.S.C. 154(b) by 0 days.

(21) Appl. No.: 09/883,911

(22) Filed: Jun. 18, 2001

(65) Prior Publication Data

US 2002/0017080 A1 Feb. 14, 2002

(30) Foreign Application Priority Data

Jun. 19, 2000 (IT) ..... BO2000A0361

(51) Int. Cl.[7] ..... B65B 11/00

(52) U.S. Cl. ..... 53/466; 53/479; 53/53; 53/233; 53/234; 53/370.6

(58) Field of Search ..... 53/466, 479, 53, 53/234, 225, 233, 370.6, 371.3, 371.5

(56) References Cited

U.S. PATENT DOCUMENTS 1,575,924 A * 3/1926 McGirr
1,875,979 A * 9/1932 Beutel
1,964,411 A 6/1934 Beutel
1,992,760 A * 2/1935 Neumair
2,016,650 A * 10/1935 Pedersen
2,130,729 A * 9/1938 Burns
2,169,591 A * 8/1939 Neumair
2,195,222 A * 3/1940 Neumair
3,090,176 A 5/1963 Craig et al.
3,152,595 A * 10/1964 Silberman
4,103,692 A * 8/1978 Baier et al. ..... 131/32
6,158,193 A * 12/2000 Focke et al. ..... 53/53

FOREIGN PATENT DOCUMENTS

GB 310982 5/1929

* cited by examiner

*Primary Examiner*—Ted Kavanaugh
(74) *Attorney, Agent, or Firm*—Marshall, Gerstein & Borun

(57) ABSTRACT

A method and machine for wrapping cigars provides for feeding the cigars continuously along a given path, along which a sheet of wrapping material is folded about each cigar, the sheet of wrapping material is closed about the cigar and at the opposite ends to form a closed wrapping, and the closed wrapping is sealed.

18 Claims, 5 Drawing Sheets

1
7
45
13
81
86
85
87
88
88
14
82
83
93
95
96
94
82
83
100
99
84
D2
42
44
46
38
12
29
30
31
35
51
50
37
47
PN
36
32
39
8
40
33
41
48
43
24
25
49
34
D1
27
25
10
11
26
P
2
21
20
21
98
23
23
22
22
16
17
8
97
19
18
9
2
15

W
a)
b)
c)
d)

a)
b)
c)
d)
e)
f)

METHOD AND MACHINE FOR WRAPPING CIGARS

The present invention relates to a method of wrapping cigars.

BACKGROUND OF THE INVENTION

Known cigar wrapping methods are implemented on wrapping machines, and provide for feeding the cigars in steps along a given path, along which a sheet of wrapping material is folded about each cigar and closed about the opposite ends of the cigar to form a closed wrapping which is then sealed. The sheet of wrapping material is folded and sealed during the pauses between two successive steps of each cigar, so that in known methods the longest operation determines the output rate of the machine as a whole. Whether performed using adhesive or heat-seal wrapping material, sealing normally take much longer than the other operations and, if speeded up, may impair the quality of the closed wrapping, which may eventually come unstuck, thus failing to protect the humidity of the cigar.

As such, known cigar wrapping methods fail to provide for both high output and quality.

SUMMARY OF THE INVENTION

It is an object of the present invention to provide a method of wrapping cigars on a wrapping machine, designed to eliminate the drawbacks of the known state of the art.

According to the present invention, there is provided a method of wrapping cigars on a wrapping machine; each cigar extending between two opposite ends; the method comprising the steps of feeding the cigars along a given path, folding a sheet of wrapping material about each cigar, closing the sheet of wrapping material about the cigar (2) and at the opposite ends to form a closed wrapping, and sealing said closed wrapping; and the method being characterized by feeding the cigars continuously along said path.

The present invention also relates to a machine for wrapping cigars.

According to the present invention, there is provided a machine for wrapping cigars, characterized by comprising an input conveyor, a transfer wheel, and a first, second and third wrapping wheel, which define the path of the cigars and are operated continuously to feed the cigars continuously along said path.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
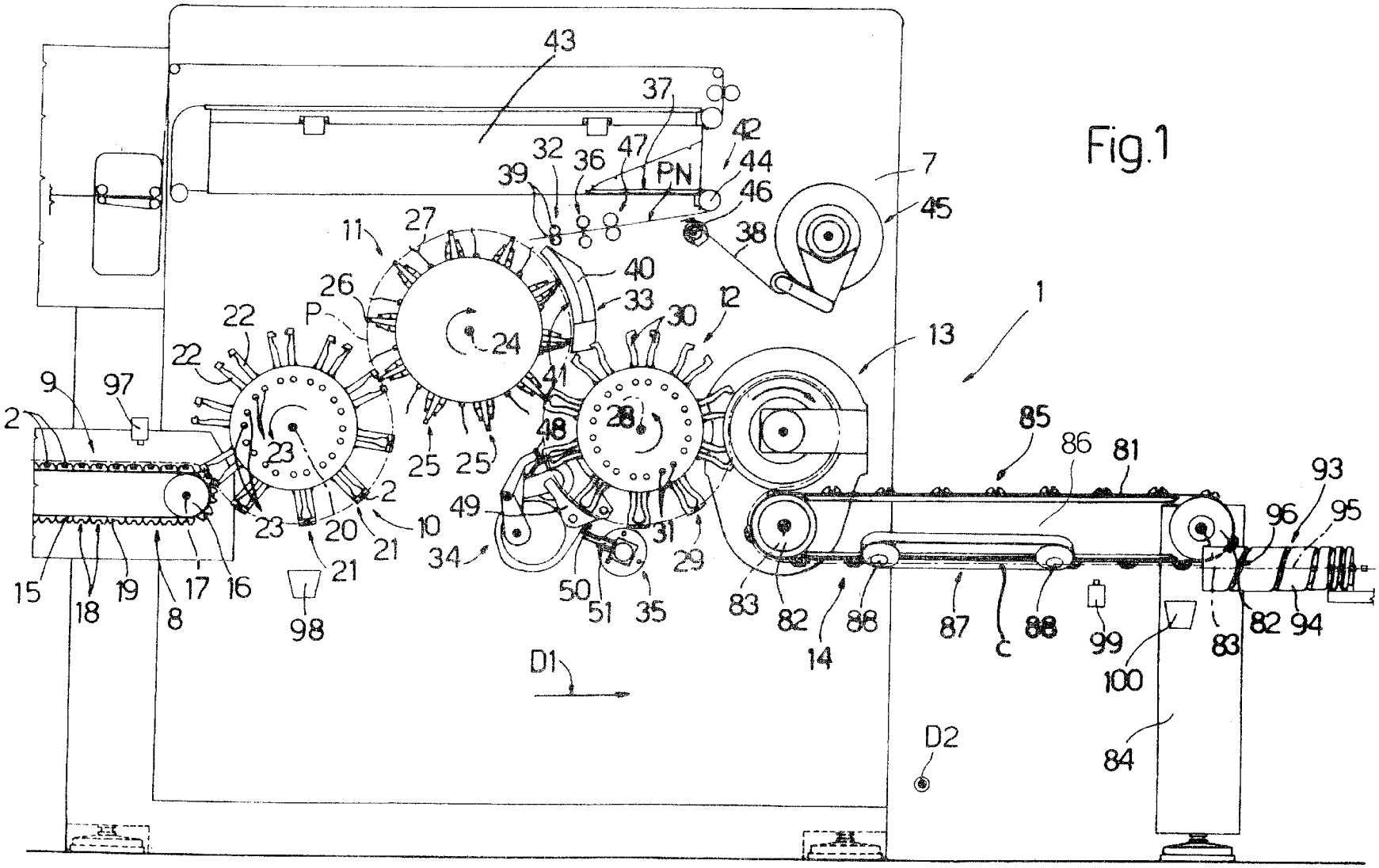
FIG. 1 shows a side view, with parts removed for clarity, of a preferred embodiment of a cigar wrapping machine in accordance with the present invention.

Number 1 in FIG. 1 indicates as a whole a machine for wrapping cigars 2.

Machine 1 provides for wrapping each cigar 2 in a respective sheet 3 of wrapping material in a succession of operations as shown in FIGS. 2*a*–2*f* and 3*a*–3*d* to form a sealed wrapping W. Each cigar 2 is tubular with a slightly square section, and has and extends between two opposite ends 4. Sheet 3 is made of transparent heat-seal material of the type in which the superimposed portions of sheet 3 exposed to a heat source are sealed to each other. The material of which sheet 3 is made is such that any portion of sheet 3 already heated and melted cannot be melted or joined further. Sheet 3 of wrapping material comprises a tear-off strip 5 adhering to sheet 3; and two notches 6 on either side of one end of tear-off strip 5.

With reference to FIG. 1, machine 1 comprises a frame 7 supporting, from left to right, an input conveyor 8 for feeding cigars 2 in an orderly succession 9 in a first direction D1; a transfer wheel 10; three wrapping wheels 11, 12, 13; and an output conveyor 14 for finish sealing sheet 3 and conveying the wrapped cigars 2 in direction D1. In actual use, cigars 2 are fed on machine 1 along a path P comprising a straight input portion parallel to direction D1, an undulated portion, and a straight output portion parallel to direction D1. Cigars 2 are fed continuously by conveyors 8 and 14 and wheels 10, 11, 12 and 13 along path P.

Conveyor 8 extends between frame 7 and a hopper (not shown) for feeding cigars 2 to conveyor 8, and comprises a belt 15 looped about two pulleys 16 (only one shown in FIG. 1) rotating about respective axes 17 parallel to a direction D2 perpendicular to the FIG. 1 plane. Belt 15 comprises a succession of seats 18 equally spaced along belt 15 and for housing respective cigars 2 by supporting ends 4 of cigars 2. Each seat 18 is defined by two pockets 19 (only one shown in FIG. 1) located a given distance apart in direction D2.

Transfer wheel 10 rotates anticlockwise in FIG. 1 about an axis 20 parallel to direction D2, and comprises a number of grippers 21 equally spaced about axis 20 and each comprising two jaws 22 rotating about respective pins 23 parallel to direction D2. Grippers 21 are movable between an open position, and a closed position in which they grip respective cigars 2 at an intermediate point between the two ends 4 of cigars 2, and are opened and closed by known cam devices not shown.

Wrapping wheel 11 rotates clockwise in FIG. 1 about an axis 24 parallel to direction D2, and comprises a number of grippers 25 equally spaced about axis 24 and each comprising two jaws 26 (only one shown in FIG. 1). Each gripper 25 is movable between an open position, and a closed position in which it grips respective cigar 2 by bringing jaws 26 into contact with the opposite ends 4 of cigar 2. In other words, each gripper 25 moves along a respective hypothetical plane through axis 24. Wheel 11 also comprises an arm 27 located at each gripper 25 and which rests on each cigar 2 to retain a sheet 3 of wrapping material at each cigar 2. Grippers 25 and arms 27 are activated by respective known cam devices not shown.

Wrapping wheel 12 rotates anticlockwise in FIG. 1 about an axis 28 parallel to direction D2, and comprises a number of grippers 29 equally spaced about axis 28 and each comprising two jaws 30 rotating about respective pins 31 parallel to direction D2. Grippers 29 are movable between an open position, and a closed position gripping respective cigars 2, and are operated by known cam devices not shown.

Wrapping wheel 11 cooperates with a device 32 for supplying sheets 3 of wrapping material, and with a folding device 33; and wheel 12 cooperates with a folding device 34 and a preseal device 35. Devices 32, 33 and 34, 35 are located at respective wheels 11 and 12 and supported by frame 7.

Device 32 for supplying sheets 3 of wrapping material comprises cutting members 36 for cutting sheets 3 off a strip 37 previously mated with a strip 38; and two feed rollers 39 for supplying sheets 3. Besides cutting off a sheet of wrapping material, the cutting of strip 37 also simultaneously forms notches 6 at strip 5, as shown more clearly in FIG. 2*a*. The two rollers 39 feed each sheet 3 crosswise to the path P of cigars 2 on wheel 11.

Folding device 33 is located immediately downstream from supply device 32, and comprises a guide 40 having a surface 41 in the form of a cylindrical sector extending about axis 24 to follow a given portion of path P of cigar 2 and fold each sheet 3 into an L onto respective cigar 2.

Machine 1 comprises a device 42 for supplying strip 37 and in turn comprising a compensating store 43 and a transmission pulley 44; and a device 45 for supply strip 38 and in turn comprising a transmission pulley 46 located at pulley 44 to feed strips 37 and 38 along a common path PN to a device 47 for joining strip 38 to strip 37. In a variation not shown, strip 38 is replaced by adhesive or heat-seal bands applied to strip 37 at the same or other portions of machine 1.

Folding device 34 comprises a movable folding member 48 for folding a portion of sheet 3 onto respective cigar 2; and a fixed folding member 49 for folding a further portion of sheet 3. Preseal device 35 comprises a head 50 fitted to a movable arm 51.

Wheel 13 closes the wrapping at ends 4 of cigar 2 in a manner and using means described in detail later on; and conveyor 14 finish seals the wrapping at ends 4 of cigar 2 in a manner and using means described in detail later on.

Figures 2, 3:
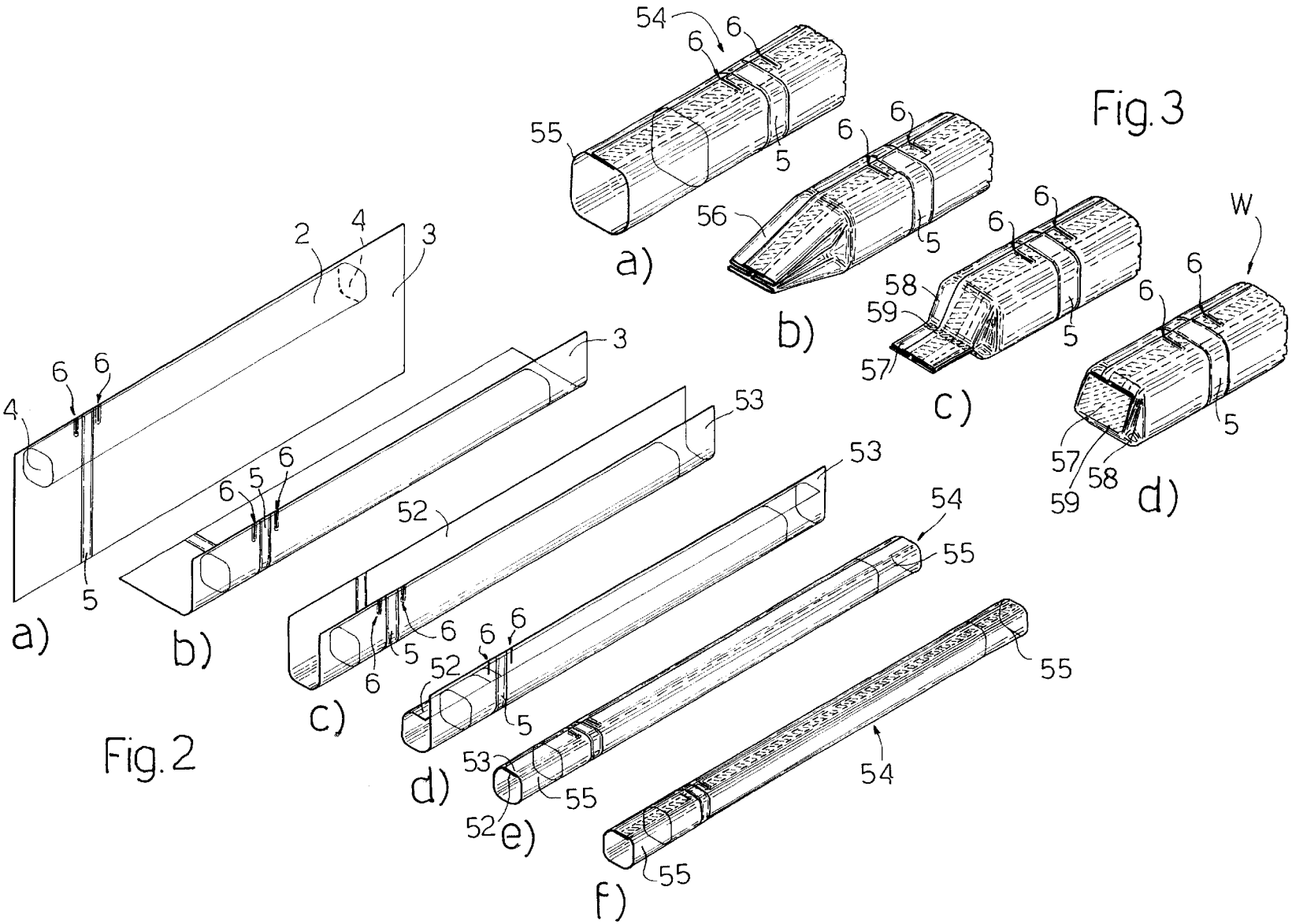
FIGS. 2*a*, 2*b*, 2*c*, 2*d*, 2*e* and 2*f* show views in perspective of a cigar at successive steps in the wrapping method according to the present invention.
FIGS. 3*a*, 3*b*, 3*c* and 3*d* show larger-scale views in perspective, with parts removed for clarity, of a cigar at successive steps in the wrapping method.

Machine 1 performs, successively along path P, the steps shown in FIGS. 2*a*–2*f* and 3*a*–3*d*. More specifically, sheet 3 of wrapping material is fed crosswise to path P of cigar 2 on wheel 11, and is maintained contacting cigar 2 by arm 27, as shown in FIG. 2*a*. As it is fed forward, sheet 3 is intercepted by guide 40 and folded into an L about cigar 2 (FIG. 2*b*). Cigar 2 and respective L-folded sheet 3 are transferred from wheel 11 to wheel 12. As it is transferred from wheel 11 to wheel 12, sheet 3 is folded into a U by grippers 29 receiving cigar 2 and respective sheet 3, and is fed along path P. At this step, the U-folded sheet 3 has two opposite, facing portions 52 and 53 extending on opposite sides of cigar 2 (FIG. 2*c*). Movable folding member 48 folds portion 52 onto cigar 2 (FIG. 2*d*), and fixed folding member 49 folds portion 53 onto cigar 2 and overlaps portions 52 and 53 (FIG. 2*e*) to form a tubular wrapping 54 comprising two tubular portions 55 in excess of the length of cigar 2 and projecting from ends 4 of cigar 2. Once tubular wrapping 54 is formed, device 35 spot seals the overlapping portion of portions 52 and 53 to seal tubular wrapping 54 (FIG. 2*f*). Head 50 comprises an inductive body which is brought into contact with superimposed portions 52 and 53.

Cigar 2 complete with respective tubular wrapping 54 is then transferred from wheel 12 to wheel 13 where portions 52 and 53 are finish sealed (FIG. 3*a*) and tubular portions 55 are pinched to form pleats 56 (FIG. 3*b*), each of which is flattened partially to form an end tongue 57 connected to a pleat 58 smaller than pleat 56. As shown in FIG. 3*c*, a continuous seal 59 is formed at the portion separating tongue 57 and pleat 58.

Cigar 2 and the respective wrapping are then transferred onto conveyor 14, along which end tongues 57 are folded about continuous seals 59 and sealed to pleats 58 (FIG. 3*d*) to form wrapping W.

Figure 4:
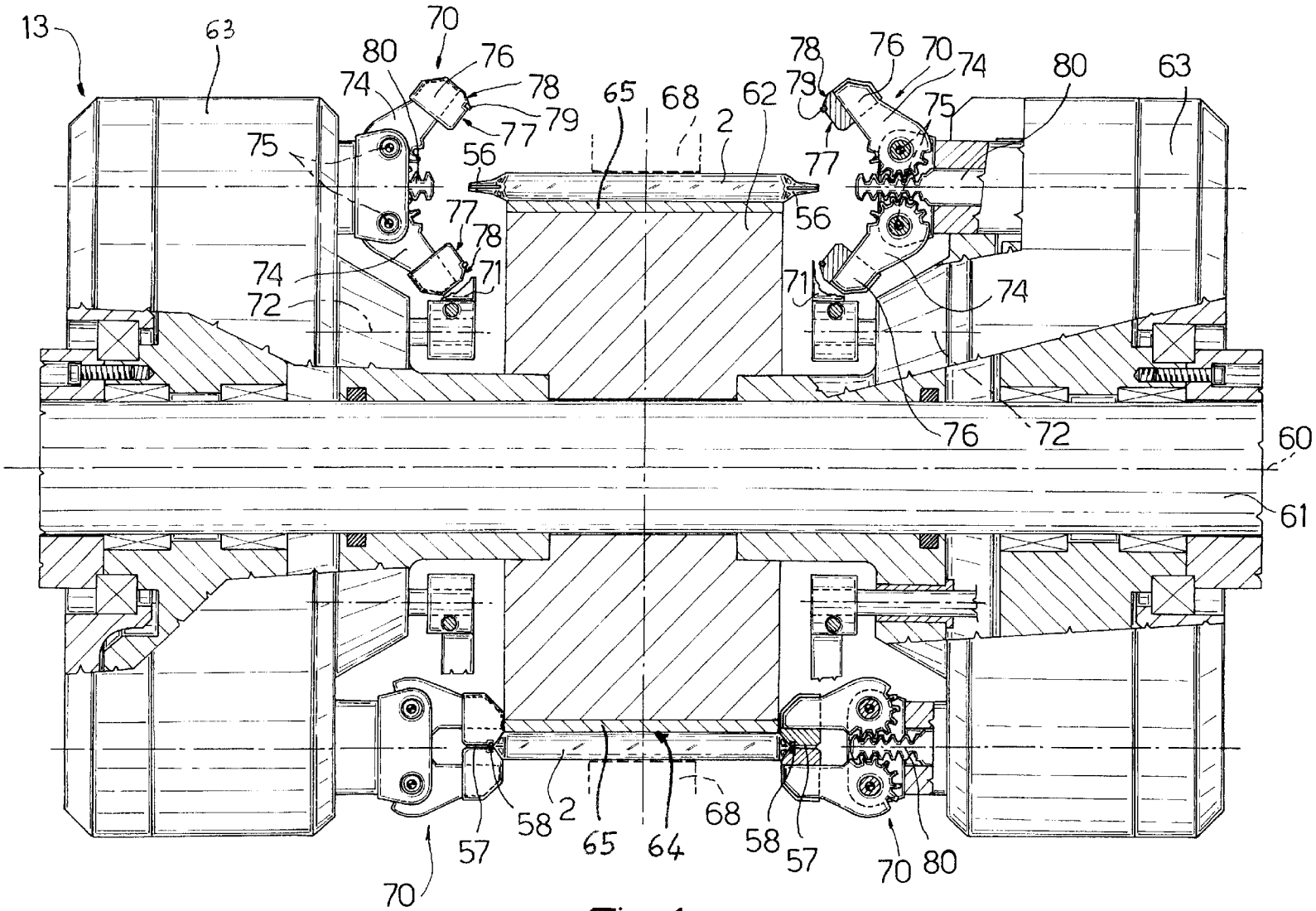
FIG. 4 shows a section, with parts removed for clarity, of a detail of the FIG. 1 cigar wrapping machine.
Figure 5:
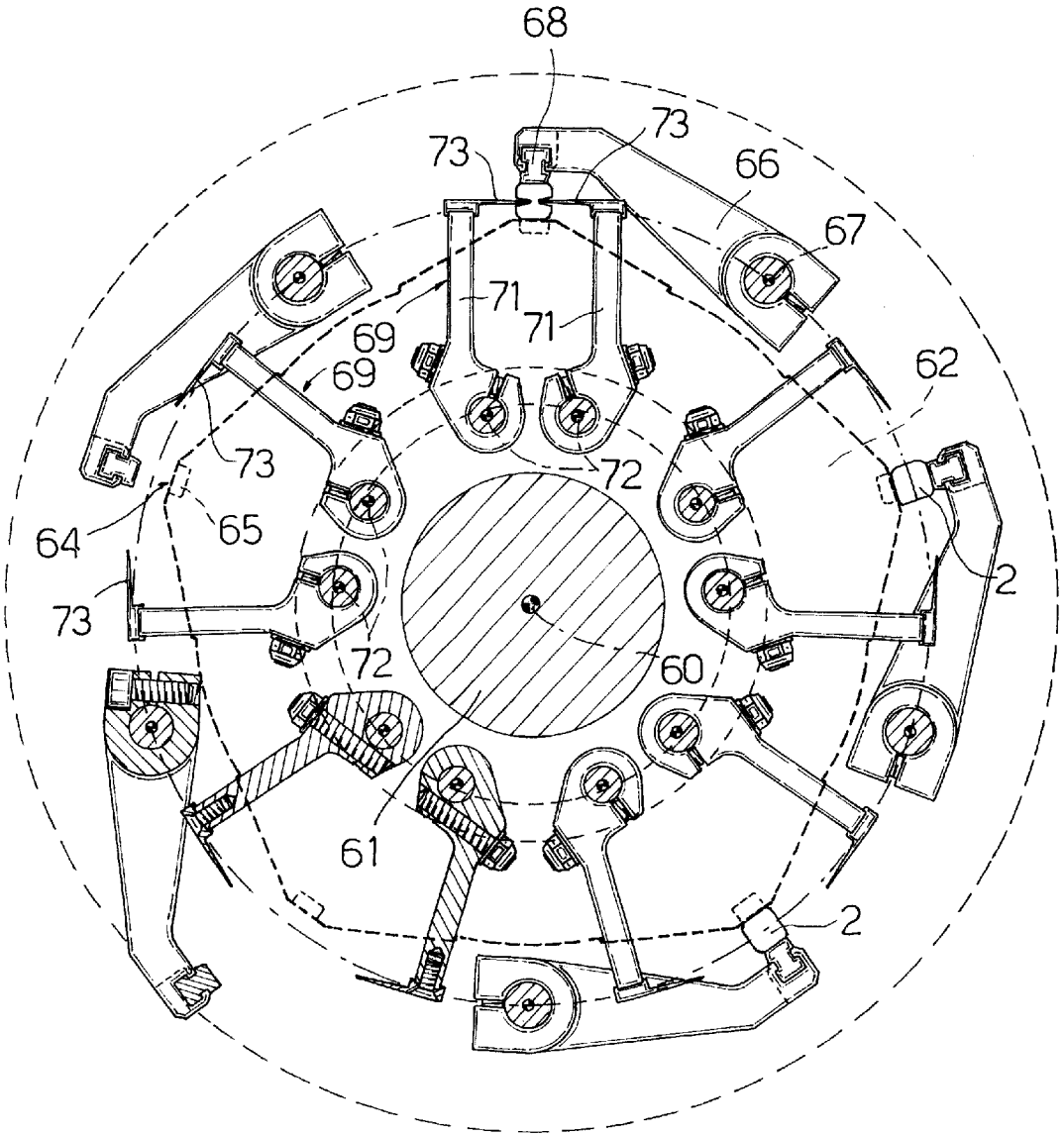
FIG. 5 shows a side view, with parts removed for clarity, of the FIG. 4 detail.

With reference to FIGS. 4 and 5, wheel 13 rotates continuously about an axis 60 parallel to direction D2, and comprises a shaft 61, a central body 62, and two lateral bodies 63. Central body 62 is integral with shaft 61, and comprises a number of seats 64 equally spaced about axis 60. Each seat 64 extends parallel to axis 60, is the same length as cigar 2, and has an inductive plate 65 extending the full length of seat 64 to seal superimposed portions 52 and 53.

Lateral bodies 63 are specularly symmetrical, are supported by shaft 61 on opposite sides of central body 62, and cooperate in supporting a number of levers 66 located between bodies 63 and at respective seats 64. Each lever 66 rotates about a respective axis 67 parallel to axis 60, and comprises a head 68 which rests on a cigar 2 complete with respective tubular wrapping 54 to retain cigar 2 and respective wrapping 54 in a given position resting in seat 64. Each lever 66 is activated by a known cam device not shown. Bodies 63 are mounted to slide along shaft 61 so as to adjust the position of lateral bodies 63 with respect to the central body, and comprise known stops (not shown) by which to fix bodies 63 to shaft 61 in respective given positions.

Each body 63 comprises a number of grippers 69 for forming pleat 56, and a number of grippers 70 for forming tongue 57 and continuous seal 59. Each gripper 69 is located at one end of a respective seat 64, and comprises two levers 71 rotating about respective axes 72 parallel to axis 60, and two blades 73 located at the free ends of respective levers 71 and which cooperate to form pleat 56 by squeezing opposite sides of tubular portion 55. Each gripper 69 is activated by a known cam device not shown. Each gripper 70 is located at one end of a respective seat 64, and comprises two levers 74 rotating about respective axes 75 perpendicular to axis 60. Each lever 74 comprises a head 76, which in turn comprises a flat face 77 cooperating with the flat face 77 of the opposite lever 74 to form tongue 57, and a face 78 following the outline of pleat 58. At the edge formed by face 77 and face 78, a sealing plate 79 is provided for forming continuous seal 59. Levers 74 of each gripper 70 are activated by a respective rack 80, which is parallel to axis 60 and moved longitudinally both ways by a cam device not shown.

With reference to FIG. 1, conveyor 14 comprises a chain 81 looped about two pulleys 82 rotating about respective axes 83 parallel to direction D2. Conveyor 14 is supported by frame 7 and a pedestal 84, and comprises a number of grippers 85 equally spaced along chain 81 and controlled by a known cam device. Conveyor 14 comprises a structure 86 supporting chain 81 and two belt-type sealing devices 87, immediately upstream from which are provided respective known fixed helical folding members (not shown), each for folding a respective tongue 57 onto pleat 58.

Figure 6:
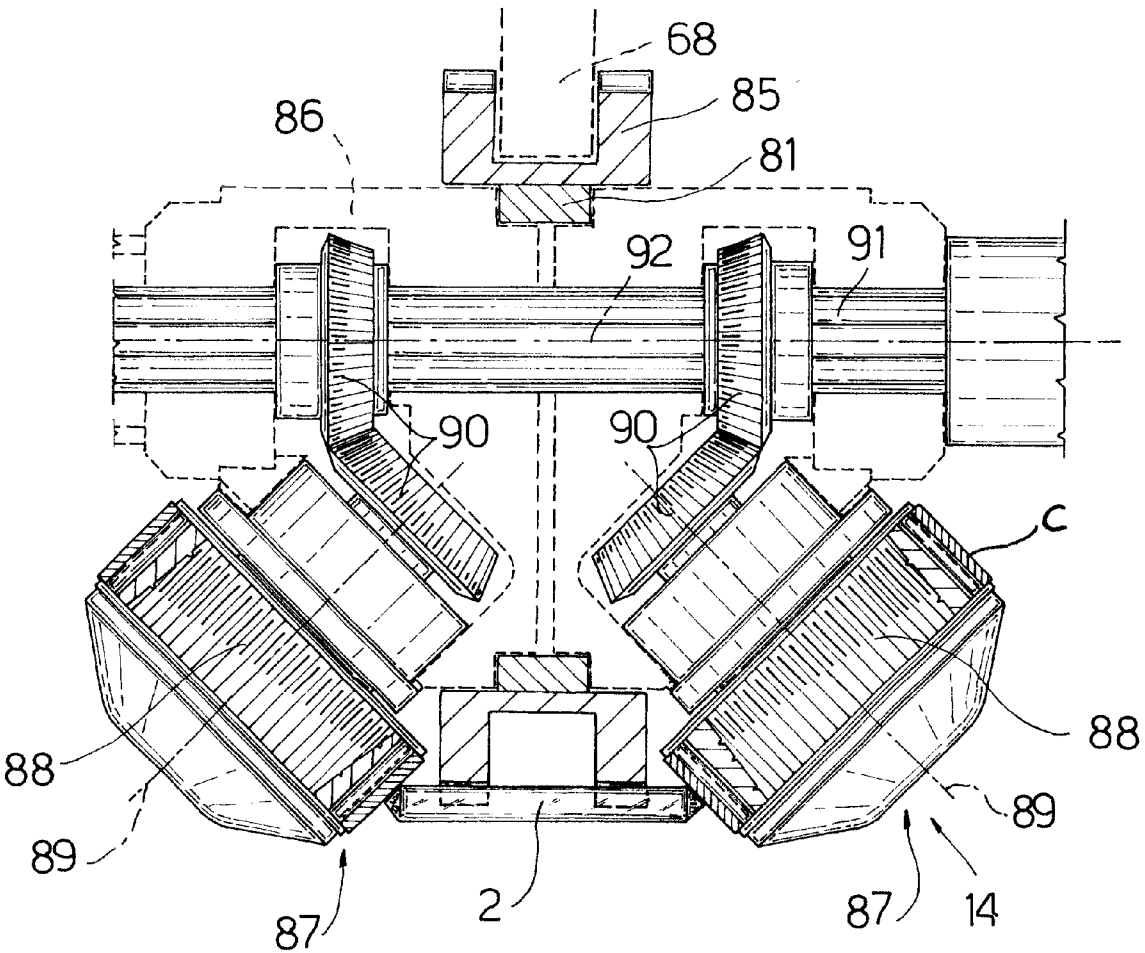
FIG. 6 shows a section, with parts removed for clarity, of a further detail of the FIG. 1 machine.

As shown more clearly in FIG. 6, each sealing device 87 comprises two pulleys 88 (only one shown in FIG. 6) about which extends an induction sealing belt C made of conducting material. Pulleys 88 rotate about respective axes 89 sloping with respect to direction D2, and are driven by bevel gears 90 and by a shaft 91 rotating about an axis 92 parallel to direction D2. Each belt C is brought into contact with a tongue 57 folded onto pleat 58 to seal tongue 57 to pleat 58. The slope of pulleys 88 is adjustable to adjust the slope of belts C with respect to tongues 57.

With reference to FIG. 1, conveyor 14 transfers the wrapped cigars 2 to a conveyor 93, which comprises two drums 94 rotating about respective axes 95 parallel to direction D1, and a supporting surface (not shown) extending between the two drums 93. Each drum 94 comprises a helical groove 96 decreasing in pitch and for housing one end of the wrapped cigar 2.

Machine 1 comprises a system for controlling cigars 2 and in turn comprising a camera 97 for detecting any faulty cigars 2 on conveyor 8, and a bin 98 located beneath transfer wheel 10 and for receiving the cigars 2 rejected off wheel 10 by opening respective grippers 21 as the cigars are transferred on wheel 10. The grippers 21 of any rejects are opened by means of an electric control which connects a cam profile to open jaws 22 in advance.

Machine 1 also comprises a system for controlling sealed wrappings W, and in turn comprising a camera 99 for detecting any faulty wrappings W on conveyor 14, and a bin 100 located beneath conveyor 14 and for receiving the faulty wrappings W rejected off conveyor 14 by opening grippers 85, which are activated by the same type of device as that described with reference to wheel 10.

The present invention has numerous advantages.

Continuously conveying cigars 2 provides for both a high output rate and high quality. Spot and continuous sealing provides for temporarily securing the wrapping, during its formation, in given forms while at the same time preserving the so-called sealing property of the wrapping material for further sealing. Dividing the path P of cigars 2 between a number of conveyors and wheels enables each conveyor and wheel to be devoted to specific operations, thus simplifying the conveyors and wheels themselves, and enables the provision of control cameras and reject bins by which to eliminate any faulty products from the production cycle. Though specific reference is made to square-section cigars, machine 1 described can also be used for wrapping constant-circular-section and variable-circular-section, e.g. tapered cylindrical, cigars.

In a variation not shown, belt-type sealing devices 87 are inverted. That is, axes 89 of pulleys 88 are positioned the opposite way to that shown in FIG. 6 so as to fold tongues 57 the opposite way.

What is claimed is:

1. A method of wrapping cigars on a wrapping machine (1); each cigar (2) extending between two opposite ends (4); the method comprising the steps of feeding with a constant speed the cigars (2) along a given path (P) in order to fold a sheet (3) of heat-sealable wrapping material about each cigar (2), close the sheet (3) of wrapping material about the cigar (2) and at the opposite ends (4) to form a closed wrapping (W), and seal said closed wrapping (W) using sealing members (50, 65, 79, C) fed together with said cigars (2) along respective portions of said path (P); said sheet (3) of wrapping material being fed crosswise to said path (P), and being folded into an L-shape about said cigar (2) on a first wrapping wheel (11); said sheet (3) of wrapping material being folded into a U-shape about said cigar (2) as said cigar (2) and the respective sheet (3) of wrapping material are transferred from the first wrapping wheel (11) to a second wrapping wheel (12); the U-folded said sheet (3) of wrapping material having a first and second portion (52, 53) opposite and facing each other.

2. The method of claim 1, wherein said sheet (3) of wrapping material is induction sealed by said sealing members (50, 65, 79, C).

3. The method of claim 1, wherein said cigar (2) is supported by the first wrapping wheel (11) between the two opposite ends (4) of the cigar (2); said sheet (3) of wrapping material being maintained contacting said cigar (2) by an arm (27) resting on the cigar (2).

4. A method of claim 1, wherein said sheet (3) of wrapping material is closed into a tube about said cigar (2) to form a tubular wrapping (54) as said cigar (2) is advanced on said second wrapping wheel (12); said tubular wrapping (54) being formed by folding the opposite said first and second portions (52, 53) onto said cigar (2) and one on top of the other.

5. The method of claim 4, wherein the first portion (52) is folded by a movable folding tool (48), and the second portion (53) by means of a fixed folding tool (49); the movable folding tool (48) and the fixed folding tool (49) being located along said path (P) at the second wrapping wheel (12).

6. The method of claim 5, wherein said first and said second portion (52, 53) are presealed; said presealing comprising the formation of spot seals along the superimposed first and second portion (52, 53).

7. The method of claim 6, wherein said presealing is performed by a first sealing member (50), which is moved towards said second wrapping wheel (12).

8. The method of claim 6, wherein said first and said second portion (52; 53) are sealed as said cigar (2) is advanced on a third wrapping wheel (13) comprising second sealing members (65).

9. The method of claim 6, wherein said tubular wrapping (54) comprises two tubular portions (55) located at the ends (4) of the cigar (2) and which exceed the length of the cigar (2); the method providing for pinching each tubular portion (55) to form a first pleat (56) on the third wrapping wheel (13).

10. The method of claim 9, wherein said first pleat is pinched to form an end tongue (57) and a second pleat (58) smaller than the first pleat (56), during conveyance on said third wrapping wheel (13).

11. The method of claim 10, wherein a continuous seal (59) is formed between the end tongue (57) and the second pleat (58) during conveyance on said third wrapping wheel (13); said third wrapping wheel comprising third sealing members (79).

12. The method of claim 11, wherein said third sealing members (79) are advanced together with said third wrapping wheel (13); said third sealing members (79) forming said continuous seal (59).

13. The method of claim 11, wherein said tongue (57) is folded onto said second pleat (58) and sealing said tongue (57) to said second pleat (58).

14. The method of claim 13, wherein said tongue (57) is folded and sealed along said path (P) on an output conveyor (14) comprising sealing members (C) which are movable along a portion of said path (P).

15. The method of claim 1, wherein the cigars (2) are controlled along an input conveyor (8) adjacent to a transfer wheel (10) to detect any faulty cigars (2) and reject the faulty cigars (2) along said transfer wheel (10).

16. The method of claim 1, wherein the sealed wrappings (W) are controlled along said output conveyor (14), and rejecting any faulty sealed wrappings (W) along said output conveyor (14).

17. A method of wrapping cigars on a wrapping machine (1); each cigar (2) extending between two opposite ends (4); the method comprising feeding with a constant speed the cigars (2) along a given path (P) in order to fold a sheet (3) of heat-sealable wrapping material about each cigar (2), close the sheet (3) of wrapping material about the cigar (2)

and at the opposite ends (4) to form a closed wrapping (W), and seal said closed wrapping (W) using sealing members (50, 65, 79, C) fed together with said cigars (2) along respective portions of said path (P).

18. A method of wrapping cigars on a wrapping machine (1); each cigar (2) extending between two opposite ends (4); the method comprising feeding with a constant speed the cigars (2) along a given path (P) in order to fold a sheet (3) of heat-sealable wrapping material about each cigar (2), close the sheet (3) of wrapping material about the cigar (2) and at the opposite ends (4) to form a closed wrapping (W), and seal said closed wrapping (W) using sealing members (50, 65, 79, C) fed together with said cigars (2) along respective portions of said path (P); said sheet (3) of wrapping material being fed crosswise to said path (P), being folded into an L-shape about said cigar (2) and then being folded into a U-shape about said cigar (2).

* * * * *

UNITED STATES PATENT AND TRADEMARK OFFICE

CERTIFICATE OF CORRECTION

PATENT NO. : 6,553,742 B2
DATED : April 29, 2003
INVENTOR(S) : Spatafora

It is certified that error appears in the above-identified patent and that said Letters Patent is hereby corrected as shown below:

Column 6,
Line 4, "A method of claim 1," should be -- The method of claim 1, --

Signed and Sealed this

Twelfth Day of August, 2003

JAMES E. ROGAN
*Director of the United States Patent and Trademark Office*